US008807691B2

(12) United States Patent
Chandu et al.

(10) Patent No.: US 8,807,691 B2
(45) Date of Patent: Aug. 19, 2014

(54) PRINT HEAD ALIGNMENT MECHANISM

(75) Inventors: Kartheek Chandu, Longmont, CO (US); Mikel J. Stanich, Longmont, CO (US); Larry M. Ernst, Longmont, CO (US); Sreenath Rao Vantaram, Rochester, NY (US); Chai Wah Wu, Hopewell Junction, NY (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 253 days.

(21) Appl. No.: 13/438,555

(22) Filed: Apr. 3, 2012

(65) Prior Publication Data

US 2013/0257969 A1 Oct. 3, 2013

(51) Int. Cl.
*B41J 29/38* (2006.01)
*B41J 29/393* (2006.01)

(52) U.S. Cl.
USPC ..... 347/19; 347/16

(58) Field of Classification Search
CPC ..... B41J 2/04504; B41J 2/2135
USPC ..... 347/19, 16
See application file for complete search history.

(56) References Cited

U.S. PATENT DOCUMENTS

| | | | | |
|---|---|---|---|---|
| 6,345,876 | B1 | 2/2002 | Tanaka et al. | |
| 6,409,301 | B1 * | 6/2002 | Takata et al. | 347/19 |
| 6,685,297 | B2 | 2/2004 | Butterfield et al. | |
| 6,883,892 | B2 | 4/2005 | Sievert et al. | |
| 7,073,883 | B2 | 7/2006 | Billow | |
| 7,273,262 | B2 | 9/2007 | McGarry et al. | |
| 7,390,073 | B2 | 6/2008 | Bailey et al. | |
| 7,472,978 | B2 | 1/2009 | Walmsley et al. | |
| 7,543,903 | B2 | 6/2009 | Little | |
| 2011/0279513 | A1 * | 11/2011 | Mizes et al. | 347/19 |
| 2012/0206531 | A1 * | 8/2012 | Mizes et al. | 347/19 |

* cited by examiner

*Primary Examiner* — Jason Uhlenhake
(74) *Attorney, Agent, or Firm* — Blakely, Sokoloff, Taylor & Zafman LLP

(57) ABSTRACT

A printing system is disclosed. The printing system includes a print engine including two or more print heads to generate an alignment chart and an alignment system. The alignment system receives the alignment chart and computes a magnitude of misalignment between the print heads.

16 Claims, 8 Drawing Sheets

PRINT HEAD ALIGNMENT MECHANISM

FIELD OF THE INVENTION

The invention relates to the field of printing systems, and in particular, to the alignment of print heads in fixed print head array structures.

BACKGROUND

Various technologies are well known for effecting printing on media. For example, laser printers, heat sublimation printers, inkjet printers, thermal printers, and the like, are well known. Color printers often have a plurality of print heads. For instance, a typical color inkjet printer has four inkjet print heads, one that utilizes black ink, and three that utilize colored inks, such as magenta, cyan and yellow. The colors from the three color print heads are typically mixed to obtain any desired color.

Although it desirable to have high alignment accuracy, manufacturing variations frequently result in misalignment of print head and/or nozzles. This results in degraded print quality. Specifically printed lines which appear to not be straight and may instead appear as a series of laterally displaced line segments. Accordingly, methods of alignment have been developed that permit print head alignment selection using software. In particular, the timing of ink ejection and ejector selection is adjusted to create proper alignment of printed dots on the print media. In order to perform such alignment methods, the amount of misalignment between print heads must be accurately computed.

Accordingly, a mechanism to compute an amount of misalignment between print heads is desired.

SUMMARY

In one embodiment, a printing system is disclosed. The printing system includes a print engine including two or more print heads to generate an alignment chart, a scanner and an alignment system. The alignment system receives the scanned alignment chart and computes a magnitude of misalignment between the print heads.

In a further embodiment, a method is disclosed including receiving an alignment chart generated by two or more print heads and computing a magnitude of misalignment between the print heads using the alignment chart.

BRIEF DESCRIPTION OF THE DRAWINGS

A better understanding of the present invention can be obtained from the following detailed description in conjunction with the following drawings, in which.

DETAILED DESCRIPTION

A print head alignment mechanism is described. In the following description, for the purposes of explanation, numerous specific details are set forth to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
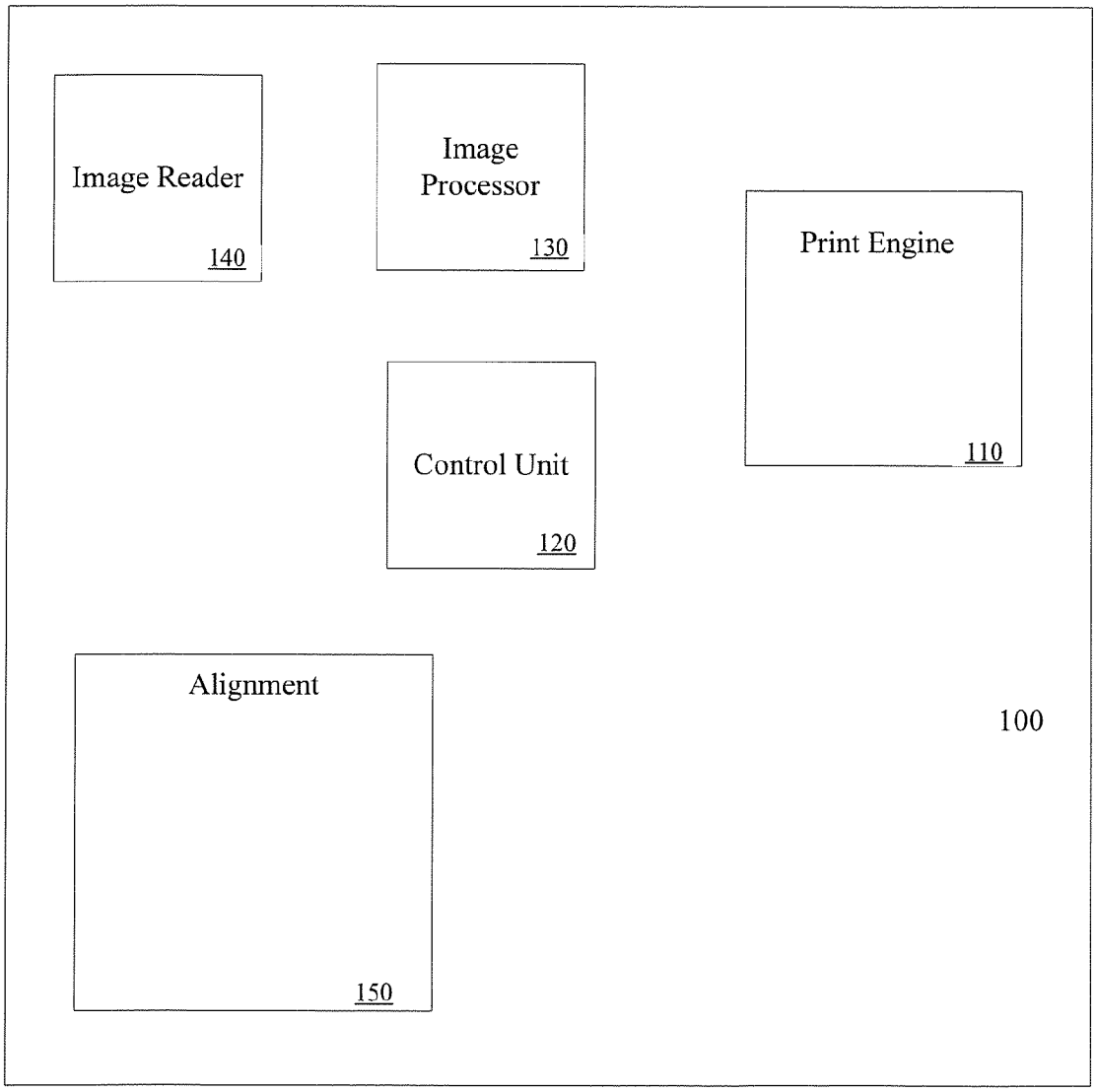
FIG. 1 illustrates one embodiment of a printer.

FIG. 1 illustrates one embodiment of a printer 100. Printer 100 includes print engine 110, control unit 120, image processor 130, and image reader 140. Print engine 110 includes print heads that apply ink to a print medium (e.g., paper). In one embodiment, print engine 110 includes four print heads arranged in a fixed inkjet print head array. In a further embodiment, print heads associated with a single color are located within the same print head tray.

Control unit 120 controls the operation of print engine 110, while image processor 130 performs rasterization of image data received at printer 100. Rasterization converts information received at printer 100 into a raster format. Particularly, image processor 130 generates a raster scan of a received image that is to be stored as scan line data in a memory array. Subsequently, image processor 130 performs halftone processing of the scan line data stored in the memory array. Control unit 120 also verifies the output of print engine 110 upon receiving image data captured by image reader 140.

Printer 100 also includes a print head alignment system 150. Alignment system 150 is implemented to provide an alignment of print engine 110 associated with each individual ink color with respect to a reference position. In a further embodiment, alignment system 150 provides a framework for computing a magnitude of misalignment between print heads in fixed print head array arrangements. Although shown as residing a component of printer 100, other embodiments may feature alignment system 150 as an independent device, or combination of devices, that is communicably coupled to printer 100.

Figure 2:
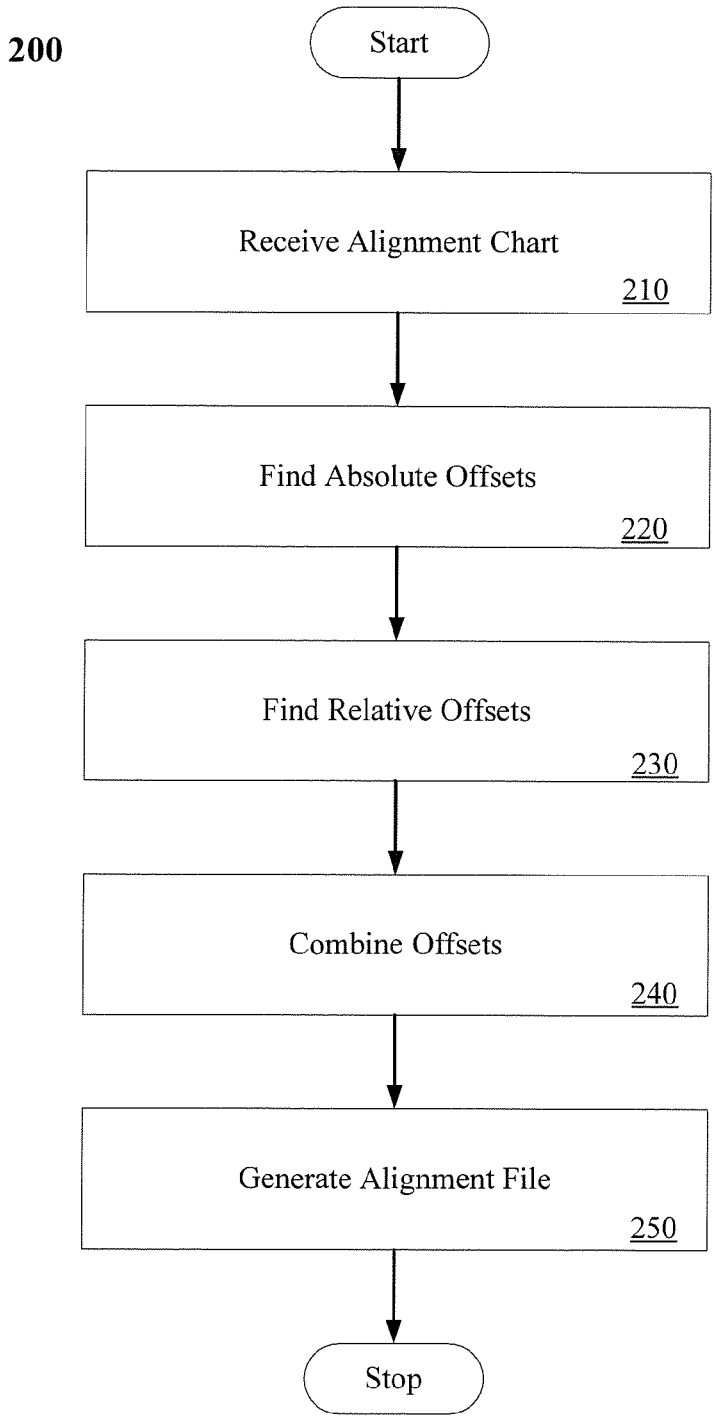
FIG. 2 is a flow diagram illustrating one embodiment of an alignment process.

FIG. 2 is a flow diagram illustrating one embodiment of an alignment process 200. Process 200 may be performed by processing logic that may include hardware (e.g., circuitry, dedicated logic, programmable logic, microcode, etc.), software such as instructions run on a processing device, or a combination thereof. In one embodiment, process 200 is performed by alignment system 150.

At processing block 210, an alignment chart is received at alignment system 150. In one embodiment, the alignment chart is a test pattern printed by the print engine 110 on a print medium by each of the four print heads. In such an embodiment, the test pattern printed on the medium is subsequently scanned by image reader 140, with the resulting digital scanned image being received at alignment system 150.

Figure 3A:
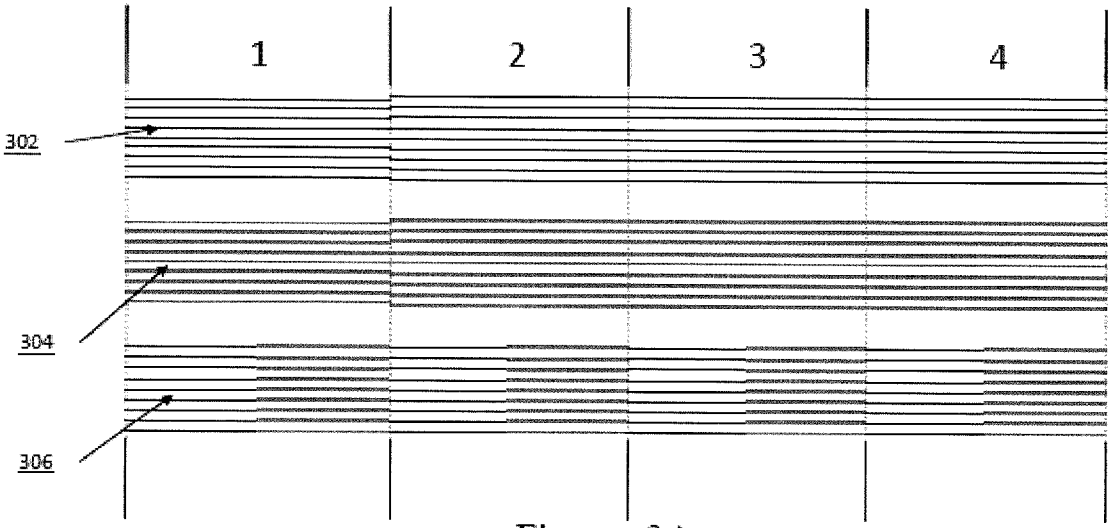
FIGS. 3A, 3B and 3C illustrate embodiments of an alignment chart.
Figure 3B:
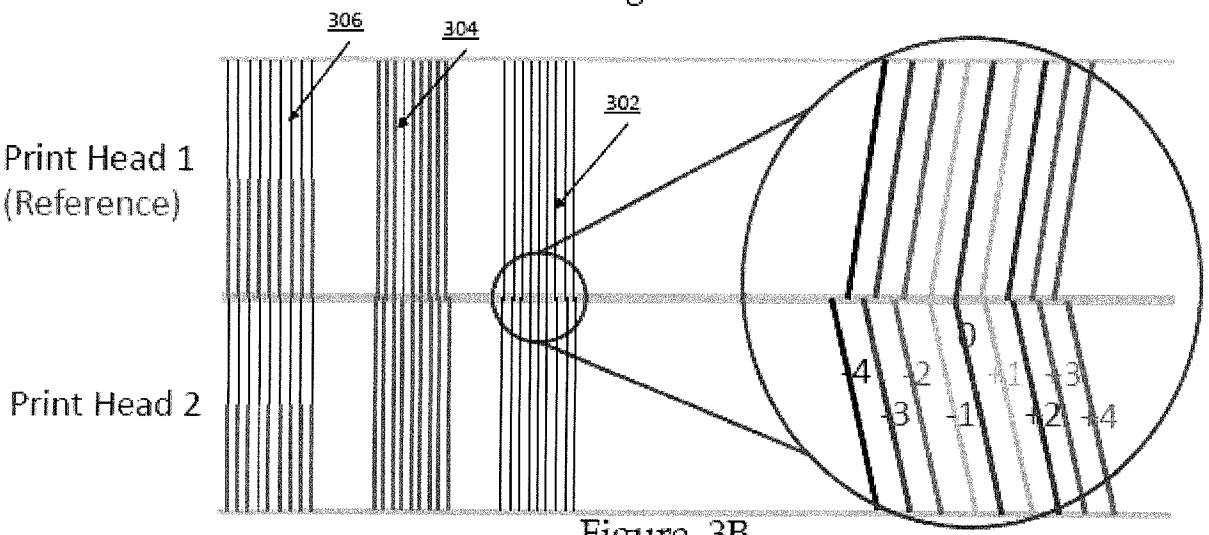
Figure 3C:
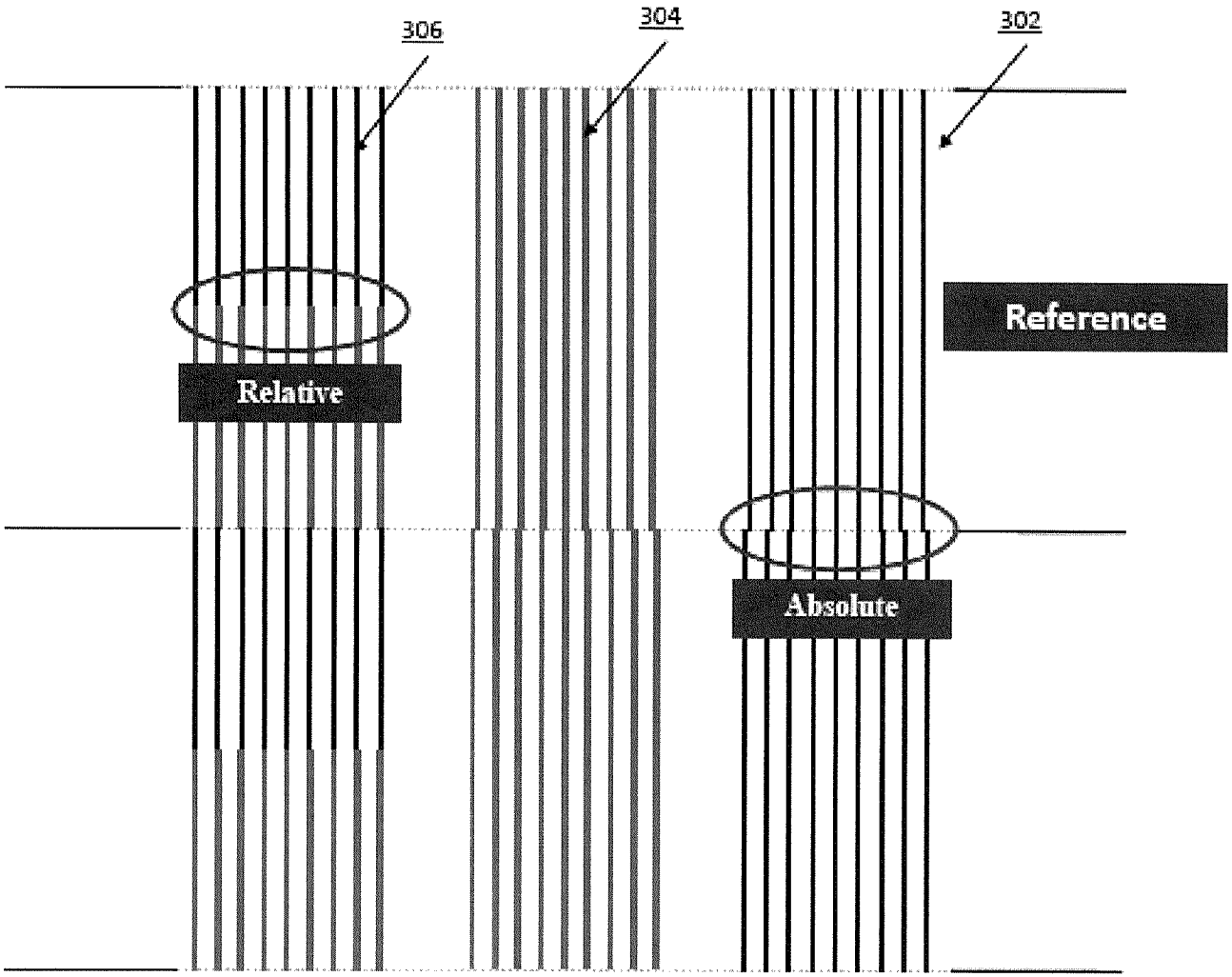

FIGS. 3A, 3B and 3C illustrate embodiments of an alignment chart. Referring to FIG. 3A, the alignment chart illustrates lines printed by print heads 1-4, as designated by the reference number above each section. In one embodiment, the alignment chart comprises test lines printed by each print head, arranged so as to indicate quantitatively the misalignment of each print head with respect to a reference print head.

In a further embodiment, the alignment chart includes a set of first color (e.g., black) lines 302, second color (e.g., magenta) lines 304 and first and second color lines 306 generated by each print head. FIG. 3B illustrates another embodiment of the alignment chart featuring print heads 1 and 2. In this embodiment, print head 1 black color is the Reference from which the alignment of all other print heads (e.g., print head 2) is measured.

In another embodiment, the objective of alignment system 150 is aligning each center line for first color group of lines 302, second lines 304 and first and second color lines 306 of the alignment chart for each print head. For instance, FIG. 3B illustrates a blown up view of first color lines 302. As shown in FIG. 3B, when the center lines for print heads 1 and 2 are aligned it results in specific offsets between the remaining lines. For example, lines to the right of the center line (labeled 0) have pel offsets of +1, +2, +3 and +4, respectively. Similarly, lines to the left of the center line 0 have −1, −2, −3 and −4 pel offsets, respectively.

Referring back to FIG. 2, absolute offsets are calculated for each print head, processing block 220. In one embodiment, an absolute offset is the offset between print heads of a given color (e.g., in a single tray), while relative offset is an offset of print heads between colors (e.g., in different print head trays). FIG. 3C illustrates another embodiment of the alignment chart of print heads 1 and 2 illustrating absolute (e.g., offset in black lines 302) and relative (e.g., offset in black and magenta lines 306).

Figure 4A:
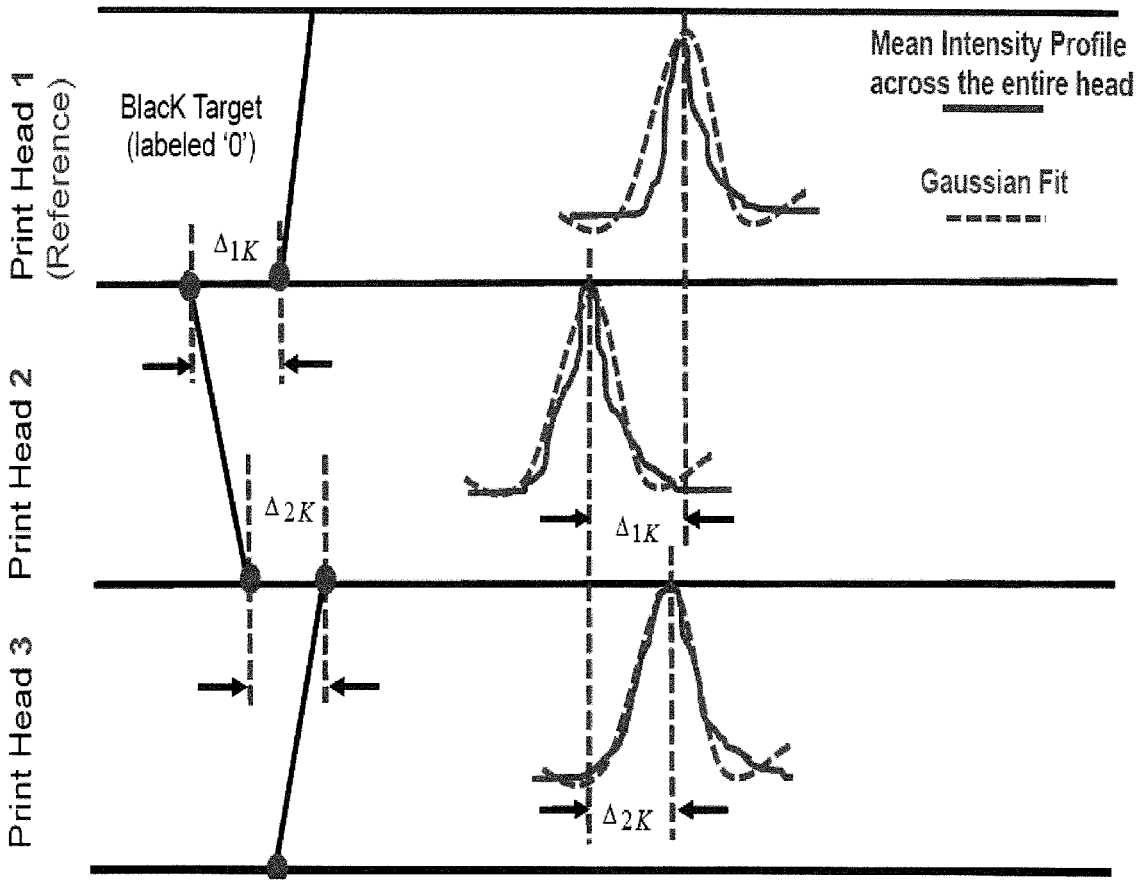
FIGS. 4A, 4B and 4C illustrate embodiments of offset computations.

FIG. 4A illustrates one embodiment of performing offset computations. In one embodiment, a mean intensity profile across the entirety of the lines printed by each print head is computed to find the offset. In such an embodiment the mean intensity profile is the arithmetic average of intensity values (or digital counts) of the first color 302, second color 304, first and second color 306 line targets across various nozzles under a given print head, derived from the scanned version of the alignment chart.

Once the mean intensity profile is computed, each line profile is mathematically modeled based on a Gaussian fit for each curve. The Gaussian profile center location values are used to compute the offset (e.g., Δ between print heads). More specifically, between a pair of print heads an absolute offset (in units of pels) for first color 302 or second color 304 is computed as the difference between the mean values of Gaussian fit location values associated with the center line in the two heads. In a similar manner, between a pair of print heads a relative offset (in units of pels) can be computed using the first and second color 306 line targets.

Figure 4B:
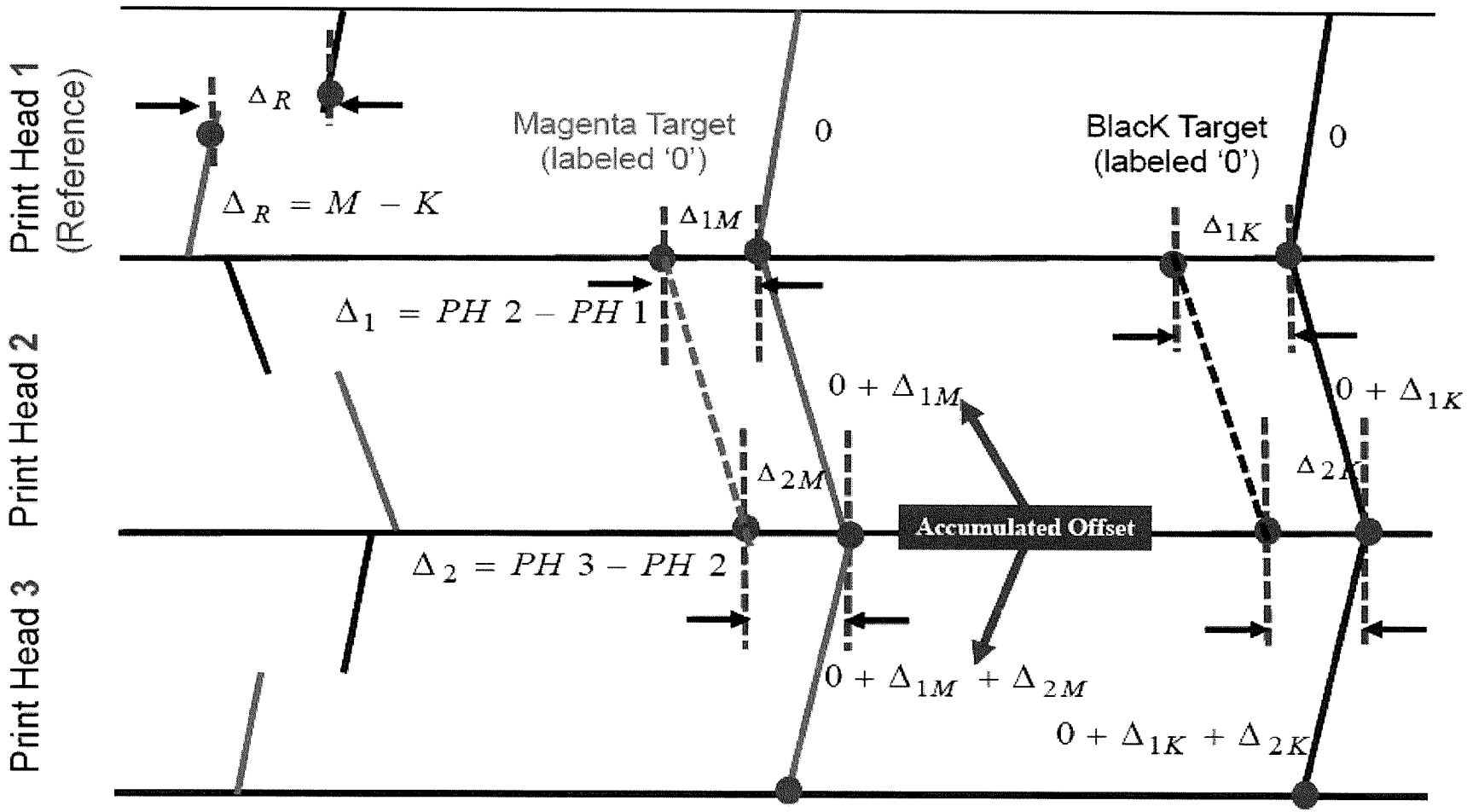

As shown in FIG. 4A, Δ1K is computed for the offset of first color (e.g., black) targets 302 between print head 1 and print head 2, while Δ2K is computed for the offset between print head 2 and print head 3. FIG. 4B illustrates a further embodiment of offset computations for black lines 302 and second color (e.g., magenta) lines 304, in which Δ1M and Δ2M are the offsets between print heads 1 and 2 and print heads 2 and 3, respectively, for the magenta target, while 1K and Δ2K represent the offsets between print heads 1 and 2 and print heads 2 and 3, respectively for the black target.

In one embodiment, accumulated offsets for all of the print heads are calculated once the offset has been calculated for each print head. For example, FIG. 4B also shows an accumulated offset (e.g. cumulative sum of offset values) for the magenta target for print head 3 as 0+Δ1M+Δ2M. Similarly, the accumulated offset for the black target for print head 3 is 0+Δ1K+Δ2K.

Referring back to FIG. 2, relative offsets are calculated for each print head after calculation of the absolute offsets, processing block 230. It should be note that this order need not necessarily be followed. For instance, the same results may be achieved with the process being reversed. FIG. 4B also illustrates the computation for a relative offset ΔR, which is the offset between a magenta line and black line in black and magenta lines 306.

Figure 4C:
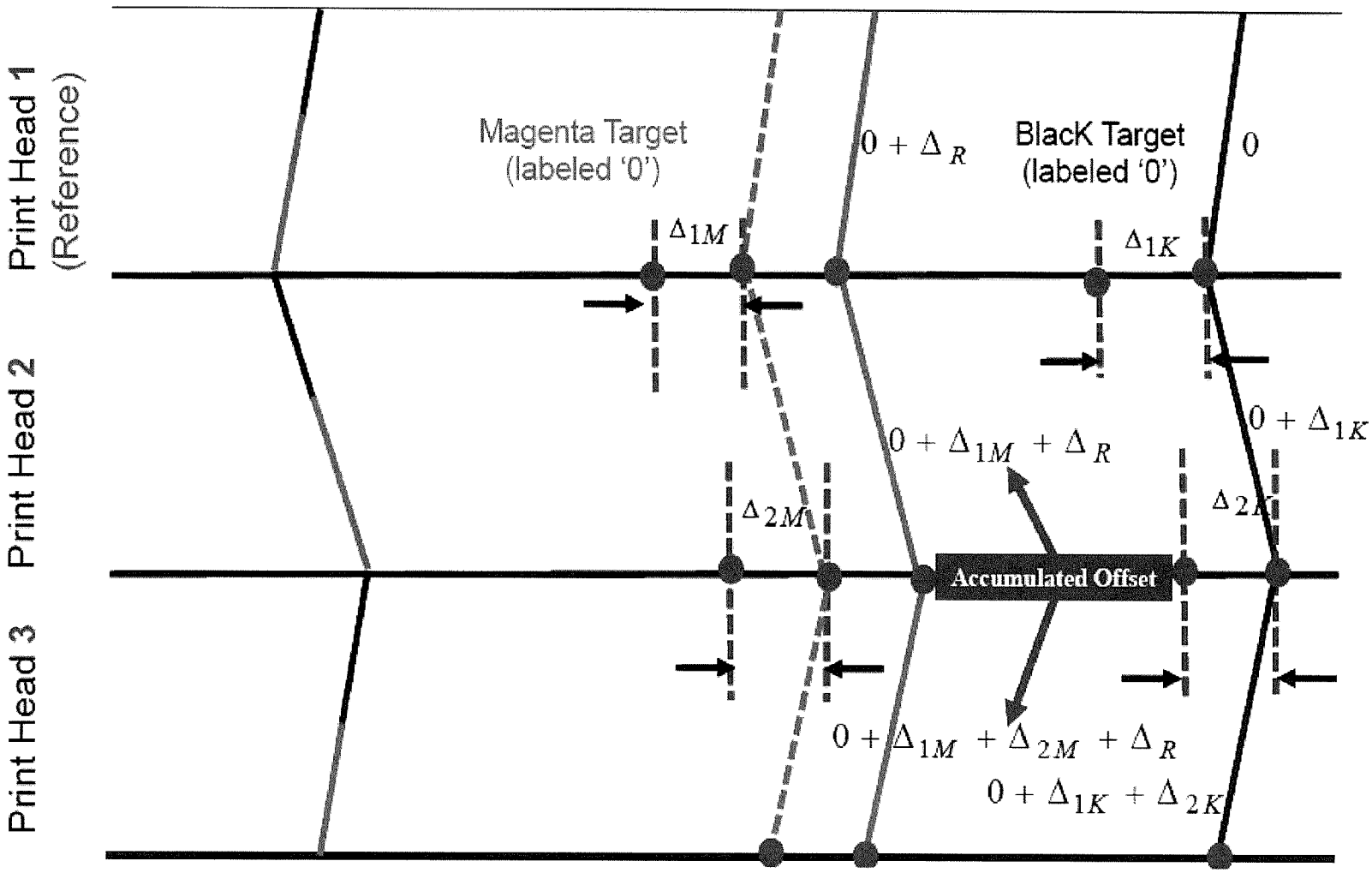

At processing block 240, the absolute and relative offsets are combined. FIG. 4C illustrates an embodiment of the relative offset being incorporated into the accumulated offset for the black and magenta targets. For instance, the accumulated offset for targets in print heads 3 is represented as 0+Δ1K+Δ2K, while for magenta line targets it is 0+Δ1M+Δ2M+ΔR (under the assumption that magenta is being aligned with respect to black).

At processing block 250, the offset computations are used to generate an alignment file. In one embodiment, the alignment file is a machine readable file that includes a single offset value for each color for each print head. The alignment file is provided to print engine 110 to provide alignment during printing of print job data.

FIGS. 4A, 4B and 4C illustrate embodiments of offset computations in embodiments implementing line segment end point-to end point print head alignment. However in other embodiments, line segment midpoint-to-line segment midpoint print head alignment may be implemented for offset computations. The difference between these two alignment methodologies is the processing using the Gaussian position parameters computed from the mean intensity profiles. The results for the two methods result in matching line segment end points for the first method, or matching line segment mid points, respectively. The midpoint approach may result in some mismatch between the end points.

The above-described mechanism provides a solution for determining and correcting misalignment between ink jet print heads.

Figure 5:
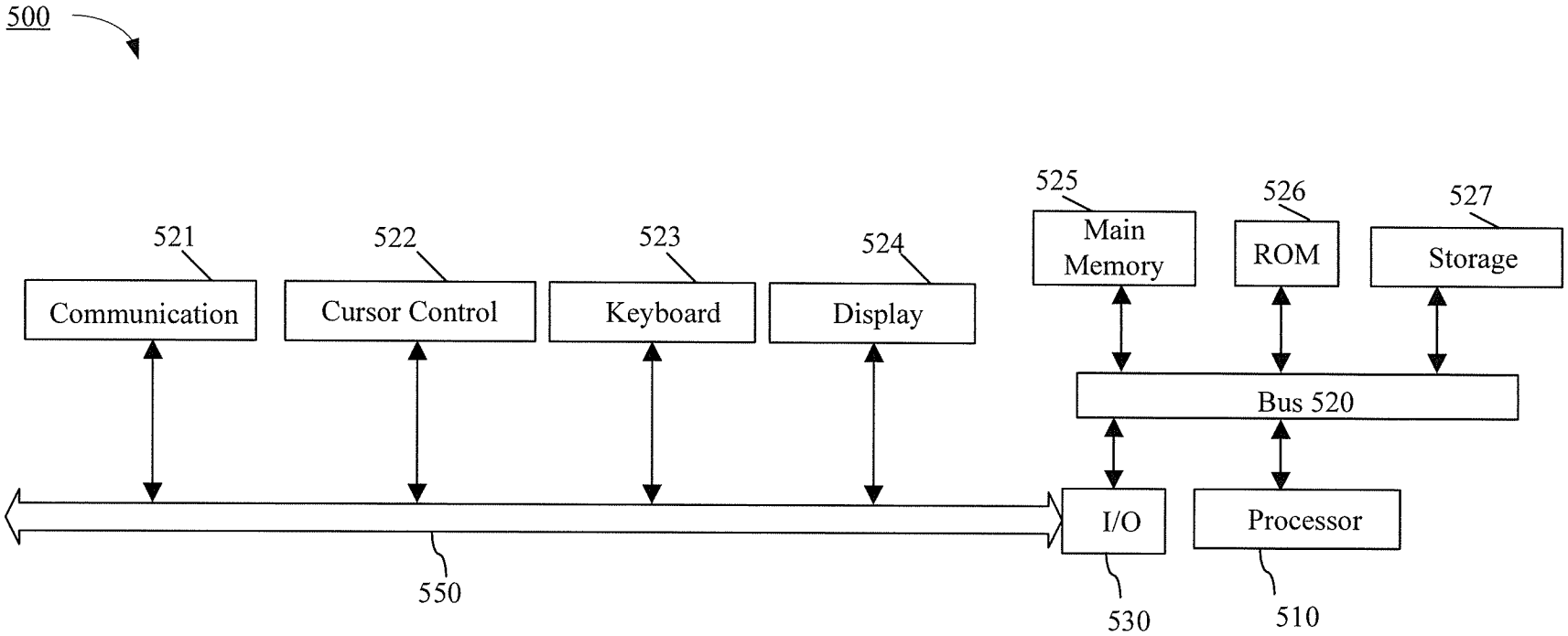
FIG. 5 illustrates one embodiment of a computer system.

FIG. 5 illustrates a computer system 500 on which printer 100 and/or alignment system 150 may be implemented. Computer system 500 includes a system bus 520 for communicating information, and a processor 510 coupled to bus 520 for processing information.

Computer system 500 further comprises a random access memory (RAM) or other dynamic storage device 525 (referred to herein as main memory), coupled to bus 520 for storing information and instructions to be executed by processor 510. Main memory 525 also may be used for storing temporary variables or other intermediate information during execution of instructions by processor 510. Computer system 500 also may include a read only memory (ROM) and or other static storage device 526 coupled to bus 520 for storing static information and instructions used by processor 510.

A data storage device 525 such as a magnetic disk or optical disc and its corresponding drive may also be coupled to computer system 500 for storing information and instructions. Computer system 500 can also be coupled to a second I/O bus 550 via an I/O interface 530. A plurality of I/O devices may be coupled to I/O bus 550, including a display device 524, an input device (e.g., an alphanumeric input device 523 and or a cursor control device 522). The communication device 521 is for accessing other computers (servers or clients). The communication device 521 may comprise a modem, a network interface card, or other well-known interface device, such as those used for coupling to Ethernet, token ring, or other types of networks.

Embodiments of the invention may include various steps as set forth above. The steps may be embodied in machine-executable instructions. The instructions can be used to cause a general-purpose or special-purpose processor to perform certain steps. Alternatively, these steps may be performed by specific hardware components that contain hardwired logic for performing the steps, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. An article of manufacture comprising a machine-readable medium including data that, when accessed by a machine, cause the machine to perform operations comprising:

receiving an alignment chart generated by two or more print heads; and computing a magnitude of misalignment between the print heads using the alignment chart by:

computing an absolute offset between print heads having a same color;

computing a relative offset between print heads having different colors;

computing an accumulated offset for each print head color; and combining the absolute offsets and the relative offsets.

2. The article of manufacture of claim 1 wherein computing the magnitude of misalignment between the print heads further comprises:

reading lines from the alignment chart generated by each of the print heads.

3. The article of manufacture of claim 2 wherein computing the absolute and relative offsets comprises:

computing a mean intensity profile for various sets of line targets in each print head; and modeling Gaussian fits for various sets of line targets in each print head.

4. The article of manufacture of claim 2 wherein computing the absolute and relative offsets comprises:

computing a mean intensity profile for various sets of line targets in each print head; and modeling Gaussian fits for various sets of line targets in each print head.

5. The article of manufacture of claim 4 wherein computing the absolute and relative offsets comprises computing the difference between the mean values of Gaussian fits associated with the center line of first color, second color, and first and second color sets of line targets in the two heads along the spatial dimension.

6. The article of manufacture of claim 5 wherein a print head is selected as reference print head.

7. The article of manufacture of claim 1 comprising a machine-readable medium including data that, when accessed by a machine, further causes the machine to perform operations comprising generating an alignment file.

8. The article of manufacture of claim 7 wherein the alignment file is a machine readable file that includes a single offset value for each color for each print head.

9. The article of manufacture of claim 8 comprising a machine-readable medium including data that, when accessed by a machine, further causes the machine to perform operations comprising transmitting the alignment file to print engine.

10. A printing system comprising:

a print engine including two or more print heads to generate an alignment chart; and an alignment system to receive the alignment chart and compute a magnitude of misalignment between the print heads by computing an absolute offset between print heads having a same color, computing a relative offset between print heads having different colors, computing an accumulated offset for each print head color and combining the absolute offsets and the relative offsets.

11. The printing system of claim 10 wherein the alignment system further computes the magnitude of misalignment between the print heads by reading lines from the alignment chart generated by each of the print heads.

12. The printing system of claim 11 wherein the alignment system computes a mean intensity profile for each set of line targets in a print head and models a Gaussian fit for each set of line targets in a print head prior to computing the absolute and relative offsets comprises.

13. The printing system of claim 12 wherein computing the absolute and relative offsets comprises computing the difference between the mean values of Gaussian fits associated with the center line of first color, second color, and first and second color sets of line targets in the two heads along a spatial dimension computing a difference between the Gaussian fit of a first print head and a second print head.

14. The printing system of claim 11 wherein the alignment system computes an accumulated offset for each print head color.

15. The printing system of claim 10 wherein the alignment file is a machine readable file that includes a single offset value for each color for each print head.

16. A method comprising:

receiving an alignment chart generated by two or more print heads; and computing a magnitude of misalignment between the print heads using the alignment chart by:

computing an absolute offset between print heads having a same color;

computing a relative offset between print heads having different colors;

computing an accumulated offset for each print head color; and combining the absolute offsets and the relative offsets.

* * * * *